US007261340B2

(12) United States Patent
Wang et al.

(10) Patent No.: US 7,261,340 B2
(45) Date of Patent: Aug. 28, 2007

(54) CAM REMOTE LATCH MECHANISM

(75) Inventors: Feng-Ho Wang, Touliou (TW); Kai-Yu Hsiao, Luchou (TW); Han-Jou Lee, Kaoshiung Hsien (TW)

(73) Assignee: Industrial Technology Research Institute, Hsinchu (TW)

( * ) Notice: Subject to any disclaimer, the term of this patent is extended or adjusted under 35 U.S.C. 154(b) by 96 days.

(21) Appl. No.: 10/921,564

(22) Filed: Aug. 18, 2004

(65) Prior Publication Data

US 2006/0012192 A1 Jan. 19, 2006

(30) Foreign Application Priority Data

Jul. 14, 2004 (TW) ..... 93121060 A

(51) Int. Cl.
*E05C 3/04* (2006.01)
*E05C 9/08* (2006.01)

(52) U.S. Cl. ..... 292/241; 292/7; 292/66; 292/DIG. 31

(58) Field of Classification Search ..... 292/241, 292/5–7, 63, 66, 109, 110, 113, 336.3, DIG. 31, 292/336.1, 341.17
See application file for complete search history.

(56) References Cited

U.S. PATENT DOCUMENTS 818,303 A * 4/1906 Seaman ..... 292/132
960,386 A * 6/1910 Obert ..... 292/66
1,573,866 A * 2/1926 Rogers ..... 292/113
1,601,687 A * 9/1926 Krayn ..... 292/7
1,640,064 A * 8/1927 Armstrong ..... 292/40
1,875,880 A * 9/1932 Moore ..... 292/66
2,336,129 A * 12/1943 Sargisson et al. ..... 292/106
2,534,396 A * 12/1950 Barnes ..... 292/113
2,574,745 A * 11/1951 Langley ..... 200/50.04
3,409,320 A * 11/1968 Eckerle ..... 292/113
4,127,016 A * 11/1978 Ibsen ..... 70/92
4,880,261 A * 11/1989 Bisbing ..... 292/7
4,893,849 A * 1/1990 Schlack ..... 292/7
5,064,228 A * 11/1991 Bisbing ..... 292/54
5,452,925 A * 9/1995 Huang ..... 292/57
5,456,504 A * 10/1995 Brillant ..... 292/63
5,551,793 A * 9/1996 Lewis ..... 403/322.1
5,688,001 A * 11/1997 Klein et al. ..... 292/67
6,543,820 B2 * 4/2003 Kelly ..... 292/97

* cited by examiner

*Primary Examiner*—Carlos Lugo
(74) *Attorney, Agent, or Firm*—Pro-Techtor Int'l Services

(57) ABSTRACT

A cam remote latch mechanism comprises a housing; a support, placed inside the housing/ being able to perform a movement between an innermost position and an outermost position; a plurality of guiding openings in the housing for guiding the movement of the support; a cam, set on a primary axis and placed inside the housing, when turned driving the movement of the support; and a pawl, mounted on an outer side of the support, protruding from the housing when the support has reached said outermost position and exerting a sealing force driven by the support, with the cam and the support stably holding each other.

3 Claims, 12 Drawing Sheets

CAM REMOTE LATCH MECHANISM

BACKGROUND OF THE INVENTION

1. Field of the Invention

The present invention relates to a cam remote latch mechanism for tightly locking of an enclosed space, like a freezer compartment, a chemical chamber or a drying chamber, particularly to a cam remote latch mechanism 10 which is driven by a cam wheel, exerting a sealing force that is adjustable by a screw.

2. Description of Related Art

U.S. Pat. No. 4,880,261 "Remote Latch Mechanism" has disclosed an apparatus for locking a door of an enclosed space, like freezer compartment, a chemical chamber or an oven. As shown in FIG. 8, the apparatus disclosed has a latch assembly with a four-link mechanism, comprising: a housing 91 at a pre-determined position, having a first guiding opening 911 of an elongated shape with a horizontal and an inclined section and a second guiding opening 912; a crank 92, mounted on the housing 91; a link 93, having one end that is hingedly connected with the crank 92; a support 94, having one end that is hingedly connected with the link 93, a first bolt 941 that enters the first guiding opening 911 and a second bolt 942 that enters the second guiding opening 912; and a pawl 95, set on the support 94, defining a right side thereof.

As shown in FIG. 9, in an unlocked state, the crank 92 has a rest angular position, the first and second bolts 941, 942 respectively enter the first and second guiding openings 912 at left ends thereof, and the pawl 95 does not extend outside of the housing 91.

As shown in FIG. 10, the crank 92, when turned away from the rest angular position thereof, drives the link 93 to push the support 94 to the right and thus the first and second bolts 941, 942 away from the left ends of the first and second guiding openings 912 towards right ends thereof, so that the pawl 95 is pushed out of the housing 91.

As shown in FIG. 11, when the second bolt 942 has reached the right end of the opening 912, further turning of the crank 92 has the support 94 follow the path of the first guiding opening 911, resulting in the pawl 95 turning downward after having reached a rightmost position, so that a sealing force is exerted on an external doorframe and, if a sealing strip has been attached to the doorframe, effective sealing is achieved. Turning the crank 92 even further will not result in loosening of the pawl 95 from the doorframe. However, the conventional remote latch mechanism just described has many structural parts and is therefore complicated and expensive to manufacture.

As shown in FIG. 12, the latch 95 has an adjusting device comprising a holding screw 951 screwed into the support 94. The right side of the support 94 and a facing left side of the pawl 95 have sawtooth-shaped surfaces 943, 952. When the holding screw 951 is loosened, the pawl 95 is movable along the right side of the support 94, adjusting the sealing force. With the holding screw 951 tightened, due to friction between the sawtooth-shaped surfaces 943, 952, the pawl 95 has a fixed position with respect to the support 94. However, placing the pawl 95 at a different position with respect to the support 94 requires loosening and retightening of the holding screw 951, which is inconvenient.

As above explanation shows, a conventional remote latch mechanism has several shortcomings.

SUMMARY OF THE INVENTION

It is the main object of the present invention to provide a cam-type remote latch mechanism with a comparatively simple structure which is inexpensive to manufacture. The present invention comprises a housing; a support, placed inside the housing, being able to perform a movement between an innermost position and an outermost position; a plurality of guiding openings in the housing for guiding the movement of the support; a cam, set on a primary axis and placed inside the housing, when turned driving the movement of the support; and a pawl, mounted on an outer side of the support, protruding from said housing when said support has reached said outermost position and exerting a sealing force driven by said support, with the cam and the support stably holding each other.

Another object of the present invention is to provide a cam-type remote latch mechanism exerting a sealing force that is easy to adjust. Thus the present invention has an adjusting screw engaging with a gliding piece on the pawl, so that, upon turning the adjusting screw, the pawl is shifted, and the sealing force thereof is adjusted.

The present invention can be more fully understood by reference to the following description and accompanying drawings.

DETAILED DESCRIPTION OF THE PREFERRED EMBODIMENTS

Figure 1:
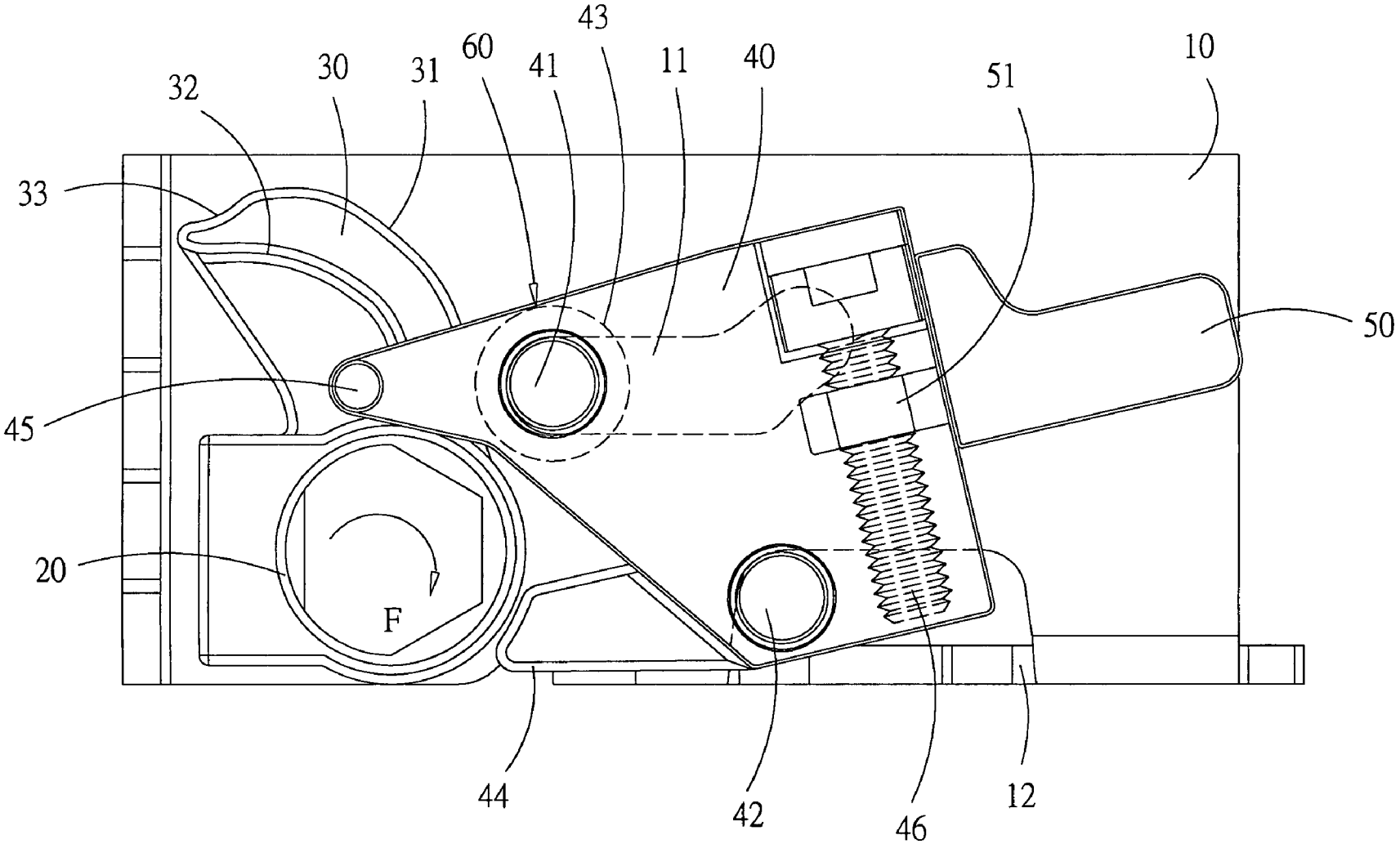
FIG. 1 is a sectional side view of the cam remote latch mechanism of the present invention in the unlocked state.
Figure 2:
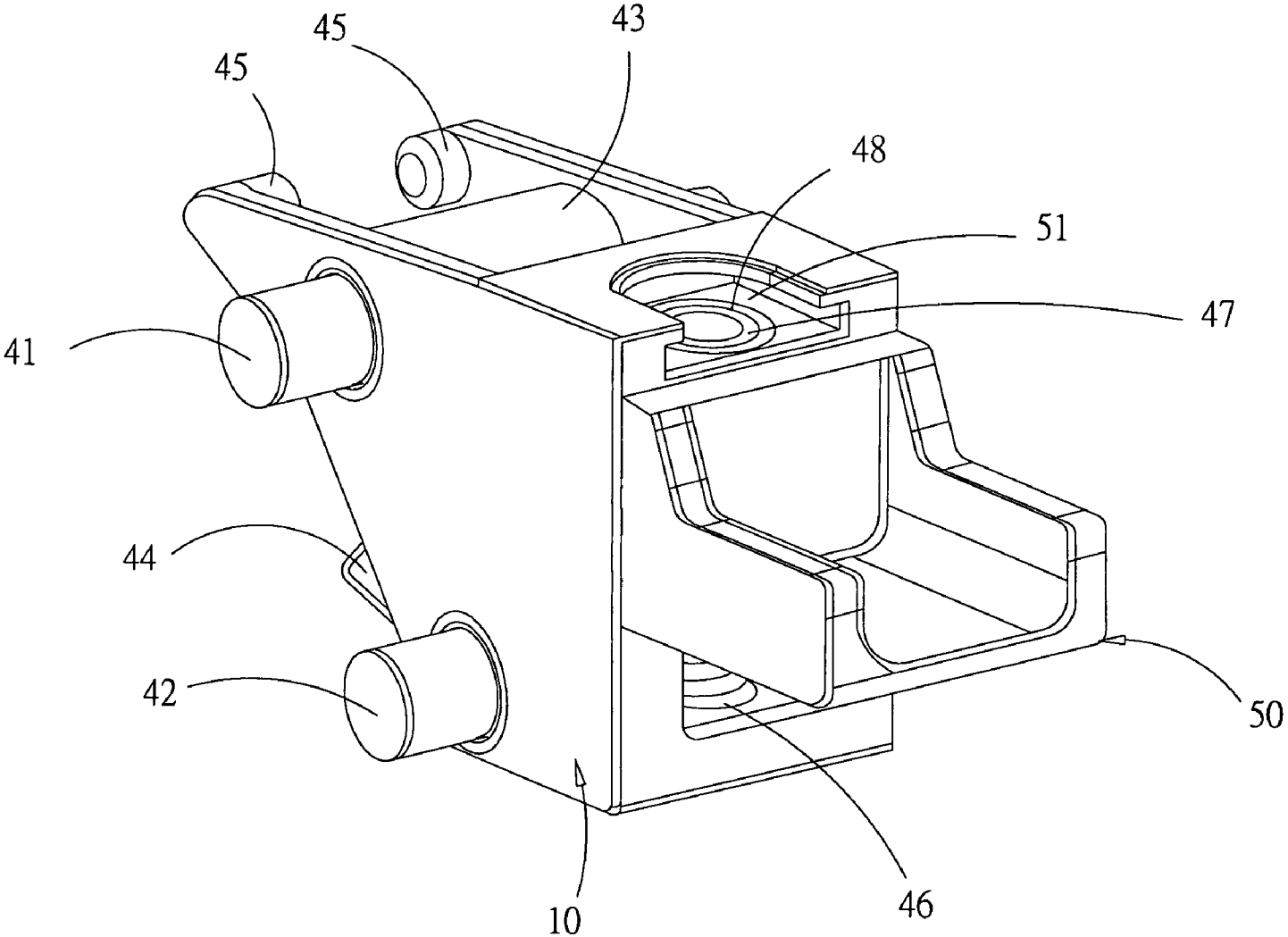
FIG. 2 is a perspective view of the cam remote latch mechanism of the present invention.

As shown in FIGS. 1 and 2, the cam remote latch mechanism of the present invention in a first embodiment comprises: a housing 10; a primary axis 20; a cam 30; a support 40; and a pawl 50. The cam 30 is linked to the primary axis 20 and mounted in the housing 10. The support 40, driven by the cam 30, is movable from a innermost position 60 to a outermost position 70 (shown in FIG. 4) in a locking movement. The support 40 on an outer side thereof carries the pawl 50 and houses a simple adjusting device. When the support 40 has reached the outermost position 70, the pawl 50 enters an external keeper 80, exerting a sealing force H thereon. Turning of the primary axis 20 in a positive direction takes along the cam 30, driving the locking movement of the support 40 within the housing 10, which results in the pawl 50 entering the keeper 80 and exerting the sealing force H thereon. The sealing force H is easily adjustable. In the following, a more detailed explanation is given.

The housing 10 has elongated first and second guiding openings 11, 12. The first guiding opening 11 has a horizontal section and an ascending section.

The primary axis 20 is mounted on the housing 10, being able to perform a turning movement, with the positive direction indicated by an arrow F in FIG. 1.

The cam 30 is attached to the primary axis 20, having a center and an outer surface 31 with a predetermined curvature for pushing the support 40 with a pushing force to perform the locking movement and a concave inner surface 32.

Figure 3:
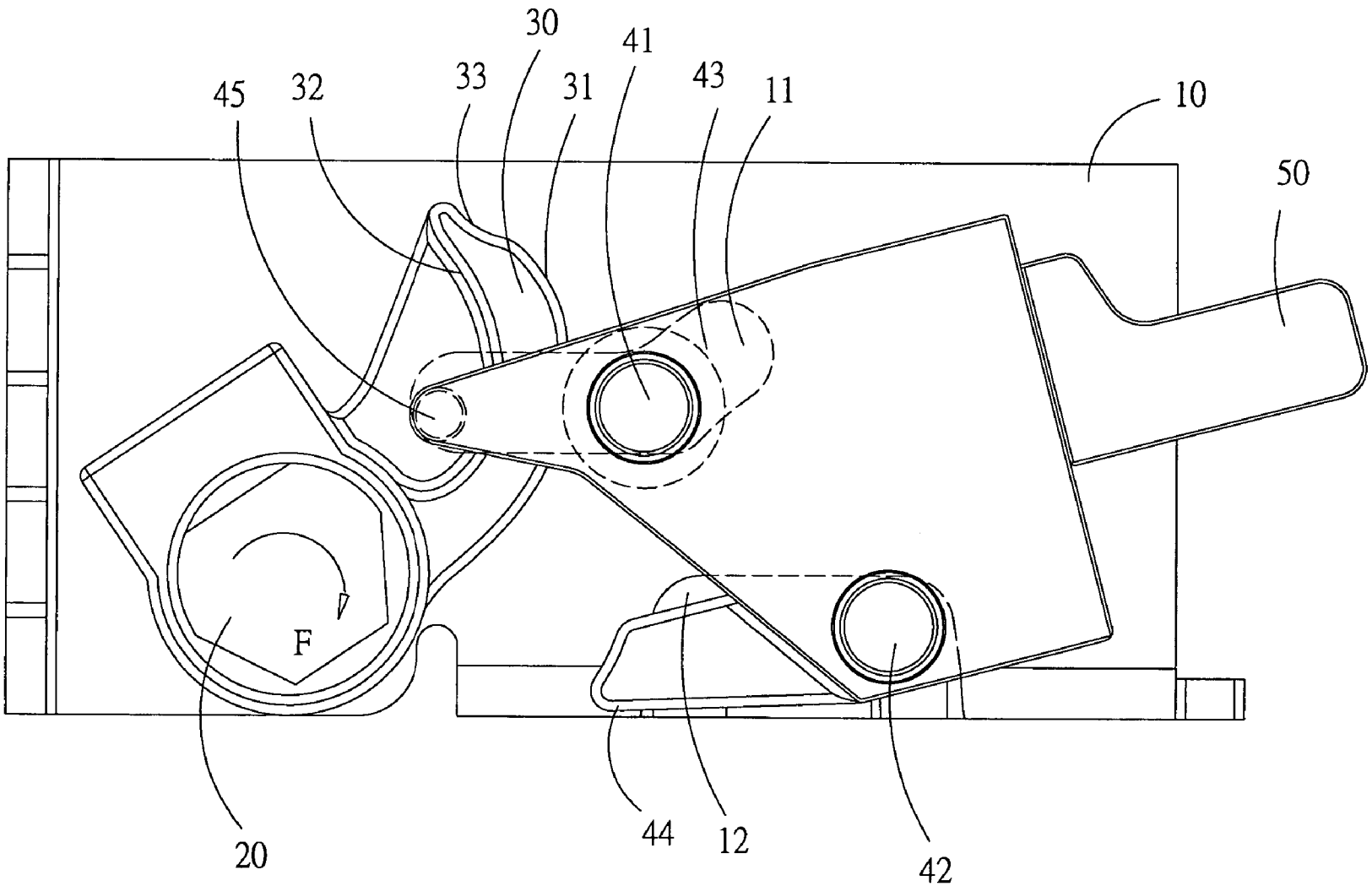
FIG. 3 is a sectional side view of the cam remote latch mechanism of the present invention during the locking movement.
Figure 4:
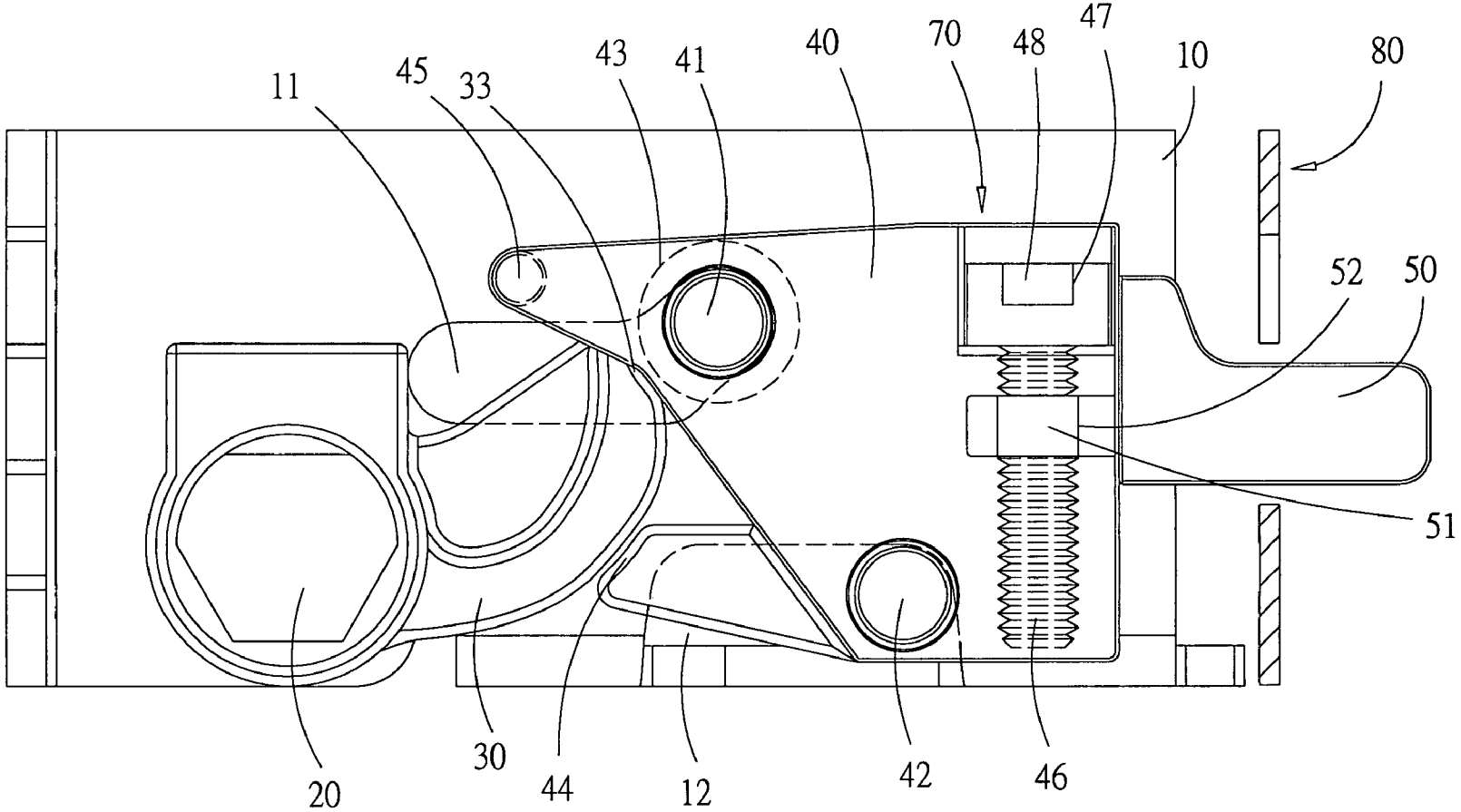
FIG. 4 is a sectional side view of the cam remote latch mechanism of the present invention in the locked state.

A first bolt 41 and a second bolt 42 protrude outward from an outer side of the support 40, passing through the first and second openings 11, 12 of the housing 10, respectively. A first roll 43 is mounted on the support 40, rolling along the outer surface 31 of the cam 30 during the locking movement, as shown in FIGS. 3 and 4. After finishing the locking movement, with the support 40 having reached the outermost position 70, the outer surface 31 of the cam 30 touches a contact area 44 of the support 40, blocking the cam 30 from being turned any further.

The pawl 50 has a mounting position on the outer side of the support 40 that is adjusted by the adjusting device inside the support 40. The adjusting device has an adjusting screw 46 which engages with a gliding piece 51 that is attached to an inner side of the pawl 50.

Referring again to FIG. 1, in an unlocked state, the primary axis 20 has a rest angular position, with the cam 30 not pushing the support 40 and the support 40 placed in the innermost position 60. The first and second bolts 41, 42 of the support 40 are placed at leftmost ends of the first and second openings 11, 12, respectively, and the pawl 50 is completely retracted inside the housing 10.

Referring to FIG. 3, after the turning movement of the primary axis 20 has been started, the outer surface 31 of the cam 30 pushes the first roll 43 rightward, causing the support 40 to perform the locking movement. With the first and second bolts 41, 42 being inserted in the first and second openings 11, 12, the support 40 first moves horizontally to the right, as long as the first bolt 41 moves within the horizontal section of the first guiding opening 11 and the second bolt 42 has not yet reached the rightmost point of the second guiding opening 12. At this stage, the pawl 50 starts to project out of the housing 10.

Referring to FIG. 4, after the first bolt 41 has reached the inclined section of the first guiding opening 11 and the second bolt 42 has reached the rightmost point of the second guiding opening 12, further turning of the cam 30 results in the support 40 to turn, as well, with the pawl 50 moving downward. When the support 40 has reached the outermost position 70, the pawl 50 exerts a sealing force on the keeper 80. The outer surface 31 of the cam 30 has an upper end with a stopping depression 33. When the support 40 has reached the outermost position 70, the first roll 43 enters the stopping depression 33. At this time, the counterforce to the pushing force of the cam 30 on the support 40 points aside from the center of the cam 30, urging the cam 30 to continue the turning movement in the positive direction under the influence of the counterforce torque F in FIG. 3. However, since the turning movement of the cam 30 is blocked by the contact area 44 of the support 40, the support 40 is firmly held in the outermost position 70, and a loosening of the pawl 50 is prevented.

Figure 5:
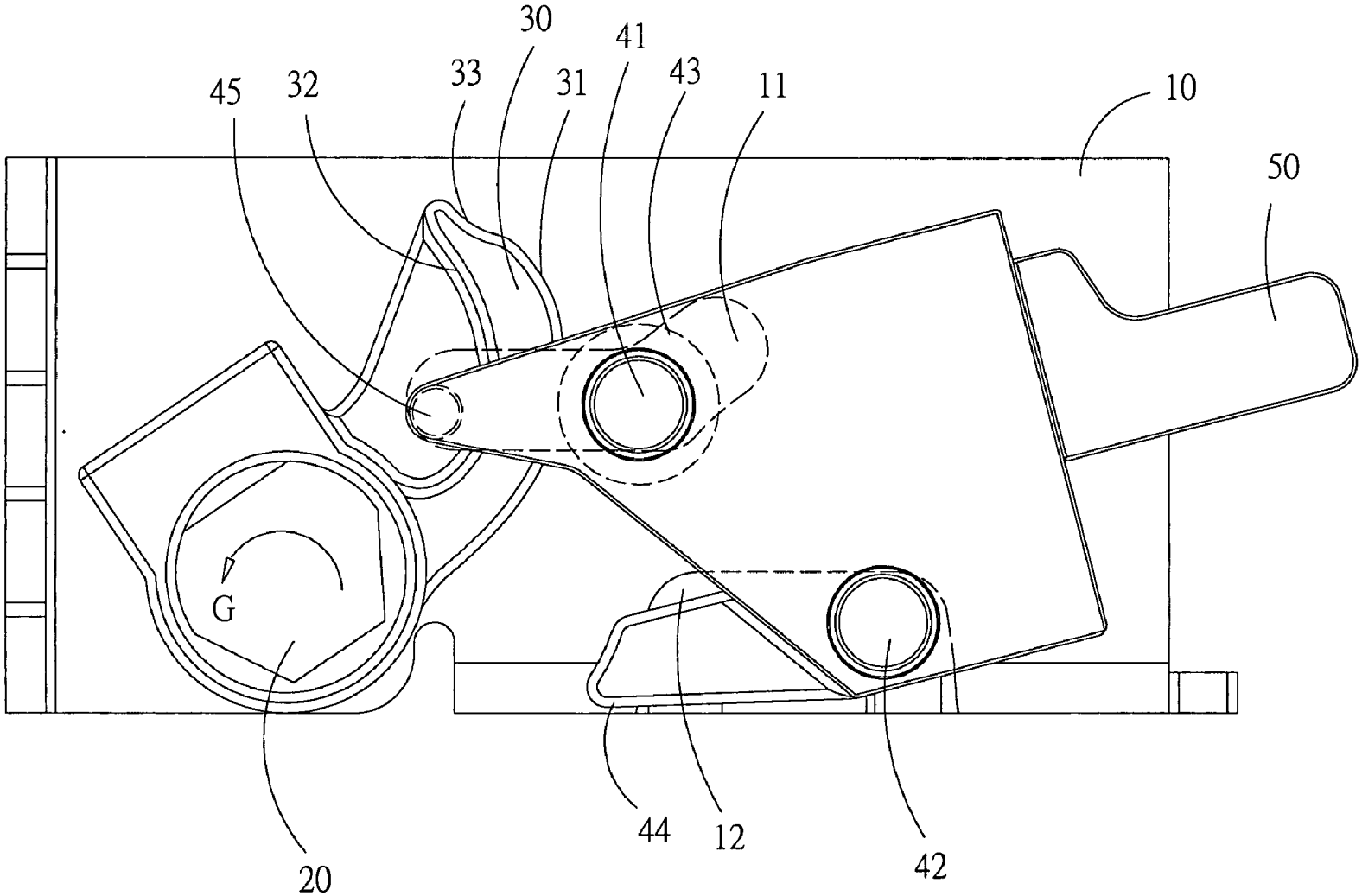
FIG. 5 is a schematic illustration of the cam remote latch mechanism of the present invention during the unlocking movement.

The support 40 furthermore has an inner end opposite to the outer side, reaching past the outer surface 31 of the cam 30. A second roll 45 is mounted at the inner end of the support 40. As shown in FIG. 5, when the crank is turned in reverse direction, indicated by an arrow G in FIG. 5, the second roll 45 leans against the inner surface 32 of the cam 30 and rolls therealong, taking the support 40 in an unlocking movement from the rightmost position 70 back to the innermost position 60.

Another characteristic of the present invention lies in easy adjusting of the mounting position of the pawl 50 on the support 40 by the adjusting screw 46, as shown in FIG. 2. The gliding piece 51 is attached to the inner side of the pawl 50, reaching into the support 40 and having an inner thread 52 that engages with the adjusting screw 46. The adjusting screw 46 has an upper end with an adjusting head 47, which is accessible from outside the housing 10. A hole 48 of a suitable shape is inserted into the adjusting head 47, allowing to turn the adjusting screw 46 with a suitable tool to adjust the mounting position of the pawl 50 on the support 40.

Employing the adjusting screw 46 greatly simplifies adjusting of the mounting position of the pawl 50. Adjusting of the mounting position of the pawl 50 is done in the locked state as shown in FIG. 4 and can be performed continuously. No repeated dismounting and mounting of the pawl 50, as in conventional art, is necessary, saving effort and time.

Figure 6:
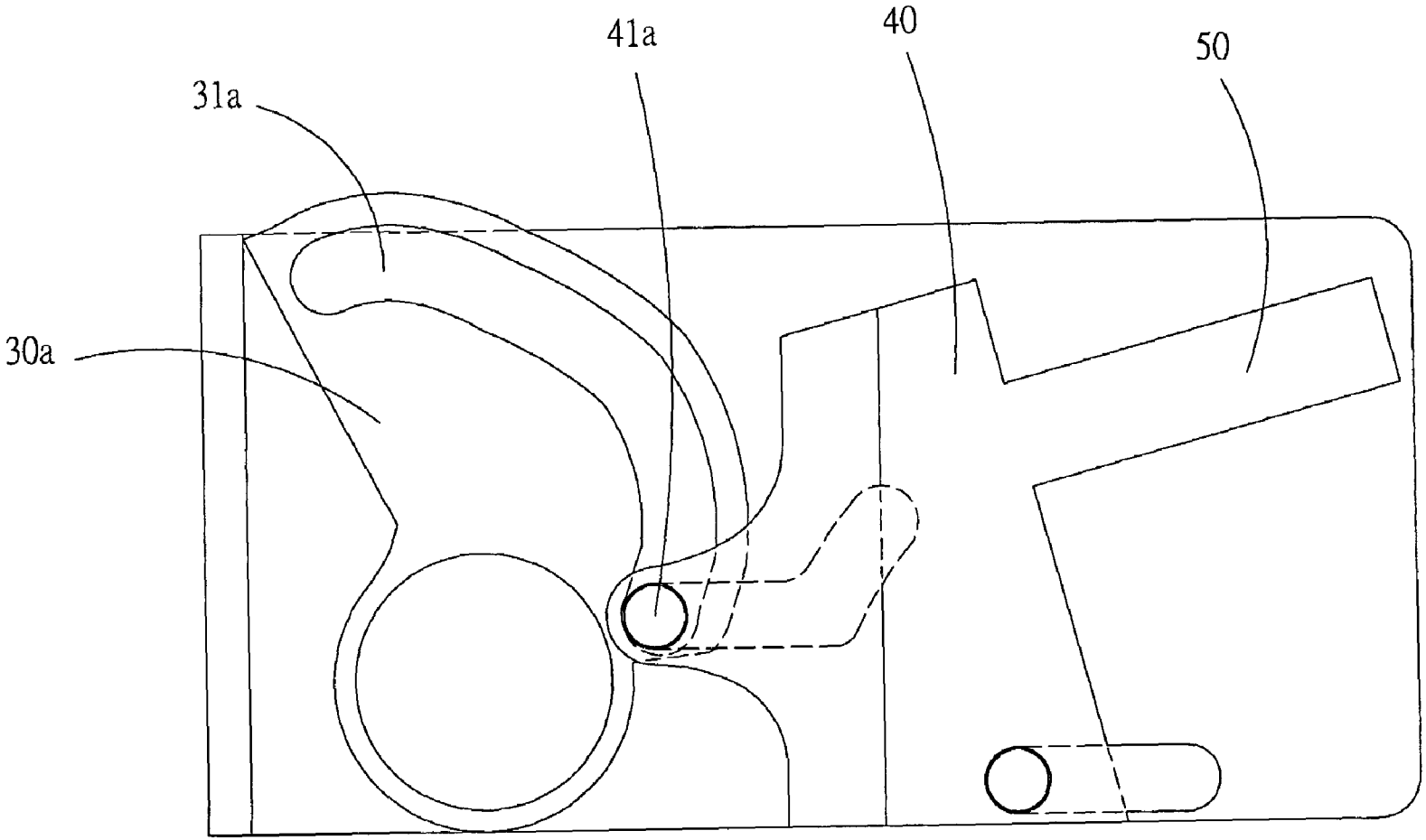
FIG. 6 is a sectional side view of the cam remote latch mechanism of the present invention in the second embodiment.

Referring now to FIG. 6, in a second embodiment of the present invention, a positive motion cam 30*a* is substituted for the cam 30. The positive motion cam 30*a* has a cam groove 31*a*. A roller 41*a* is mounted on the inner end of the support 40 and inserted into the cam groove 31*a*. When the positive motion cam 30*a* turns in positive direction, the cam groove 31*a* moves along, driving the locking movement of the support 40. Conversely, when the positive motion cam 30*a* turns in reverse direction, the cam groove 31*a* pulls the support 40 back towards the innermost position 60.

Although structural parts in the first and second embodiments of the present invention differ, movement and effect thereof are the same.

Figure 7:
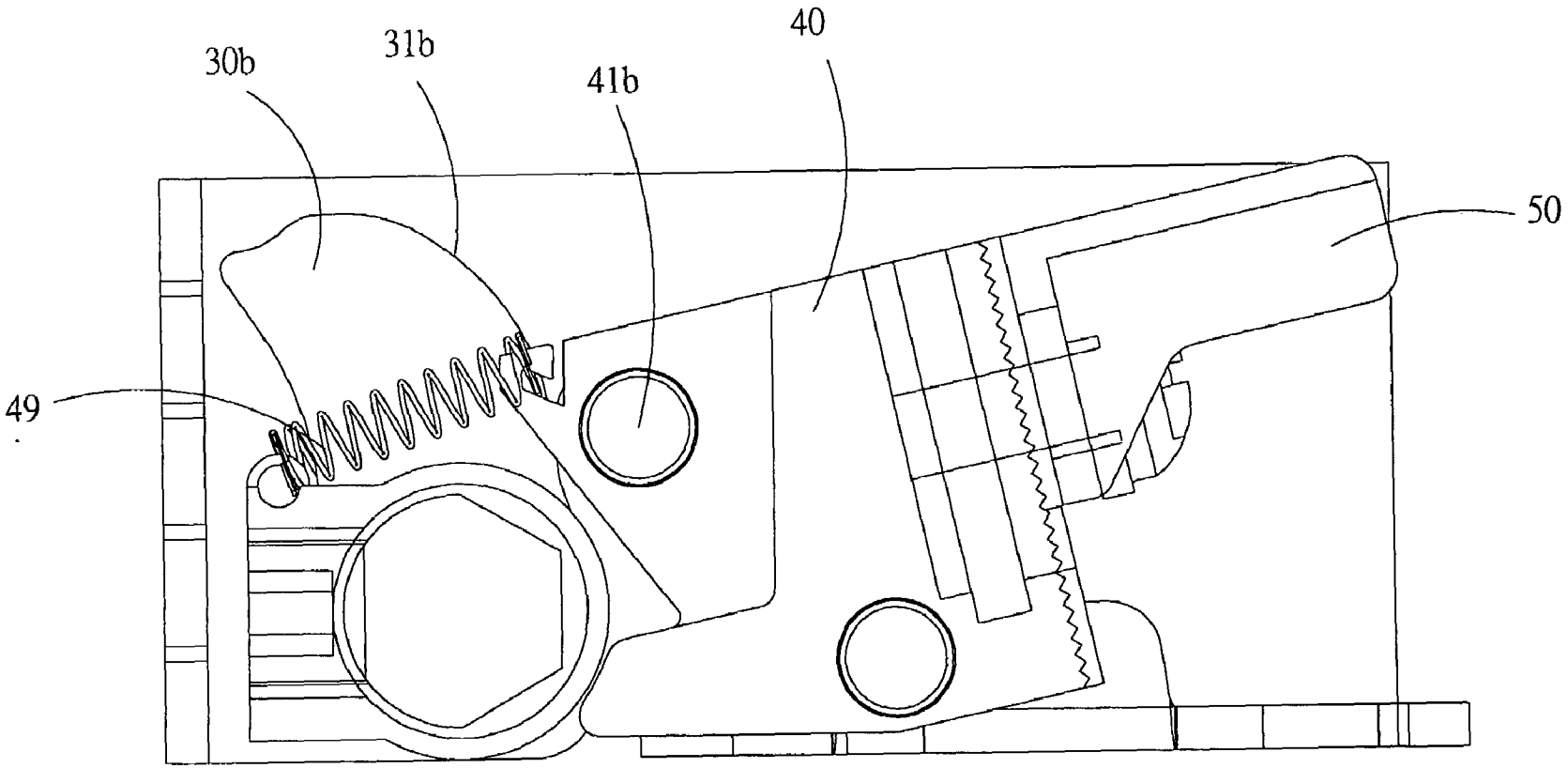
FIG. 7 is a sectional side view of the cam remote latch mechanism of the present invention in the third embodiment.
Figure 8:
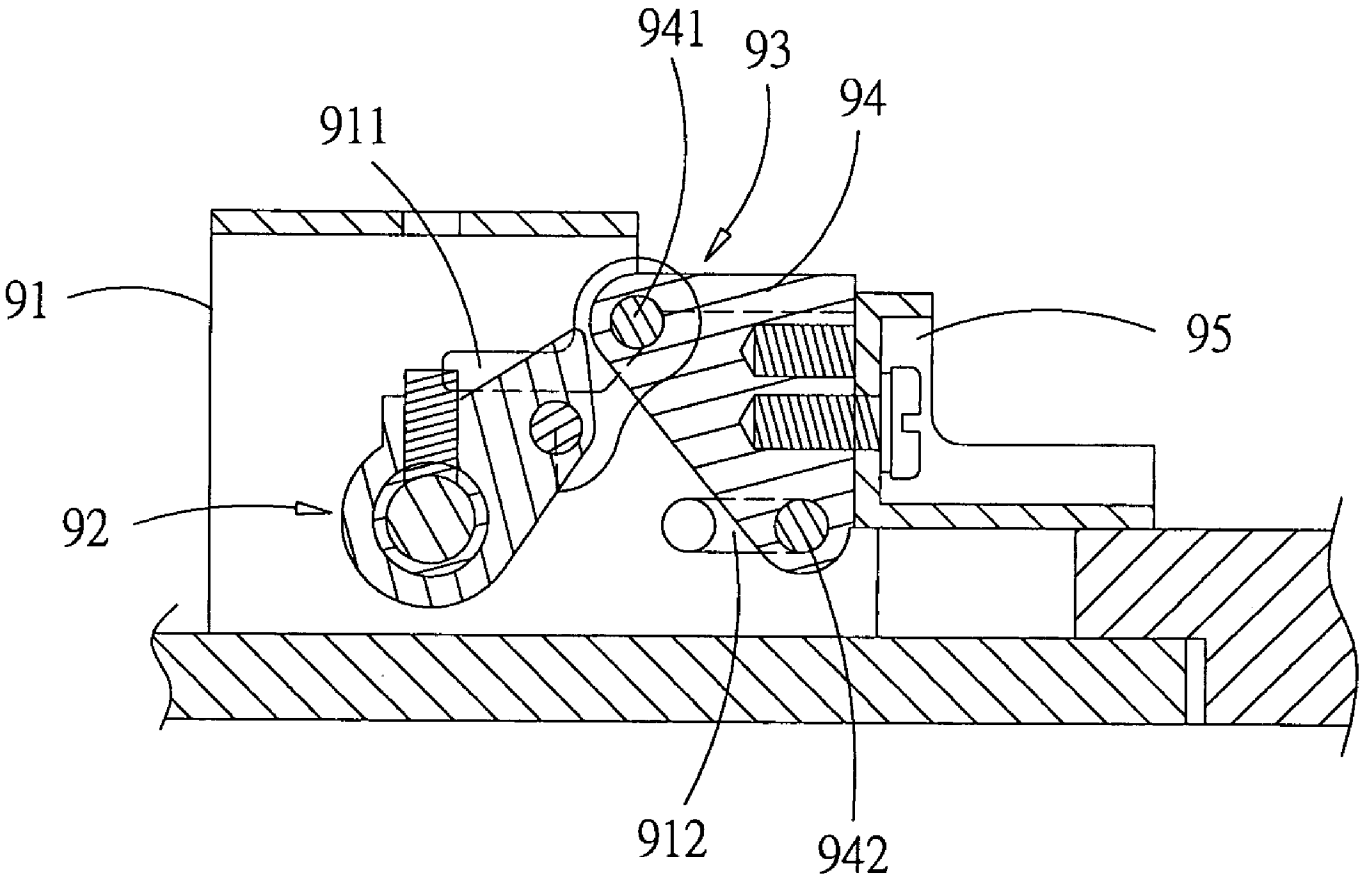
FIG 8 (PRIOR ART)
FIG. 8 (prior art) is a sectional side view of a conventional remote latch mechanism.
Figure 9:
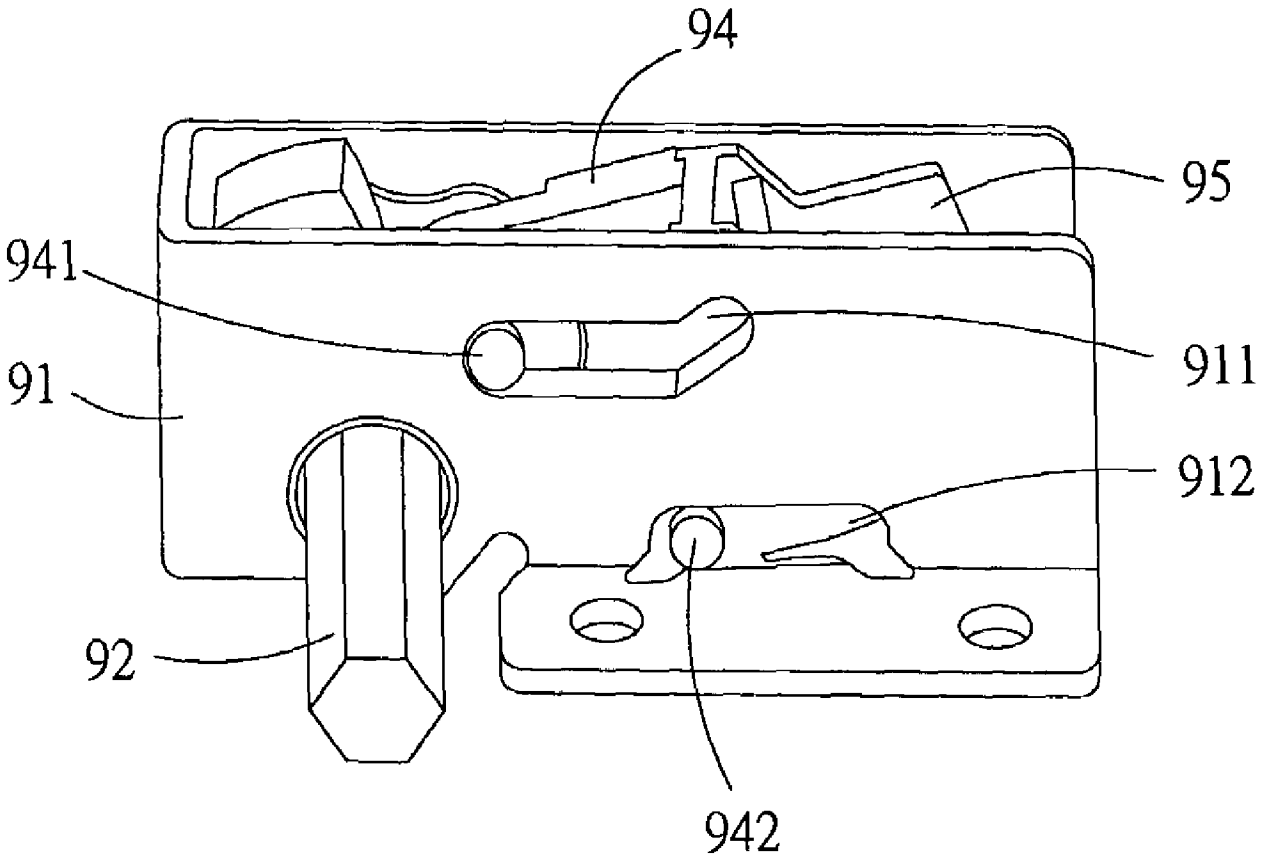
FIG 9 (PRIOR ART)
FIG. 9 (prior art) is a perspective view of the conventional remote latch mechanism of FIG. 8 in the unlocked state.
Figure 10:
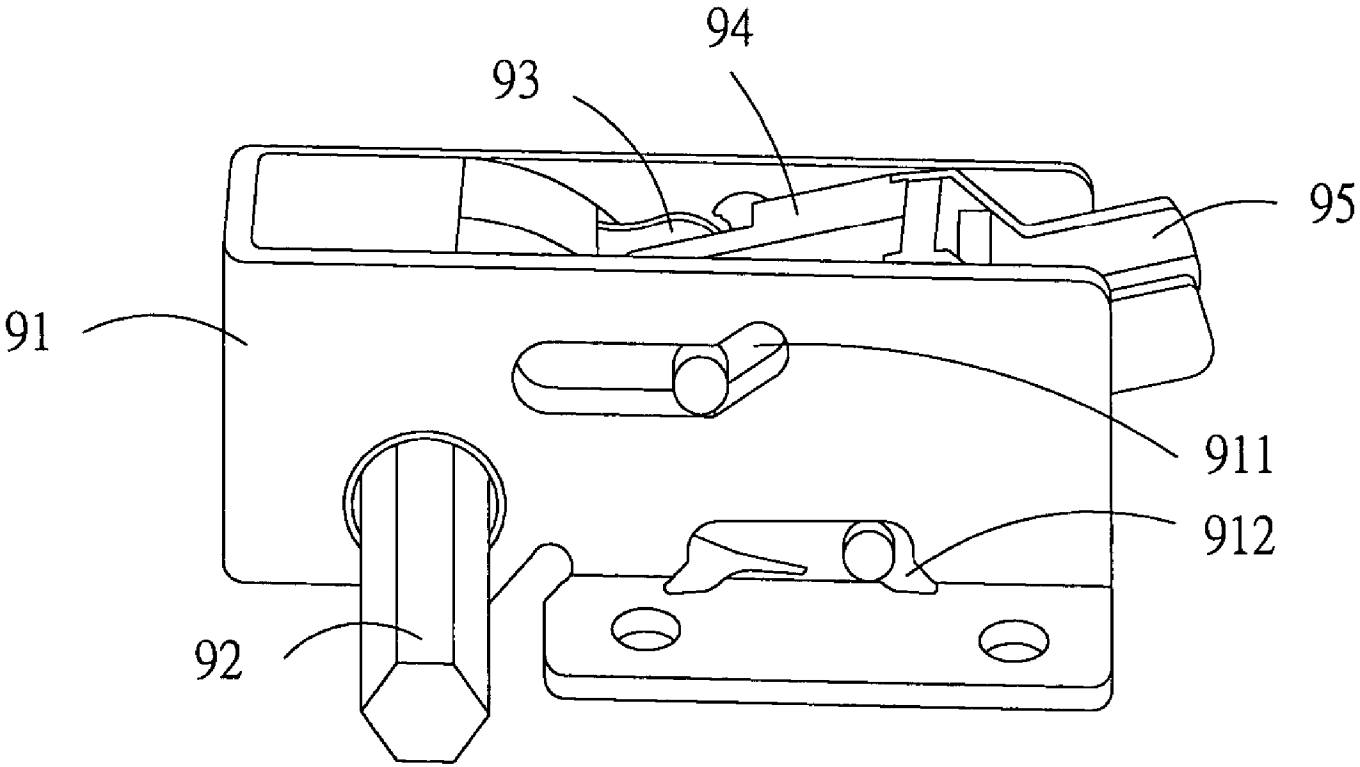
FIG 10 (PRIOR ART)
FIG. 10 (prior art) is a perspective view of the conventional remote latch mechanism of FIG. 8 during the locking movement.
Figure 11:
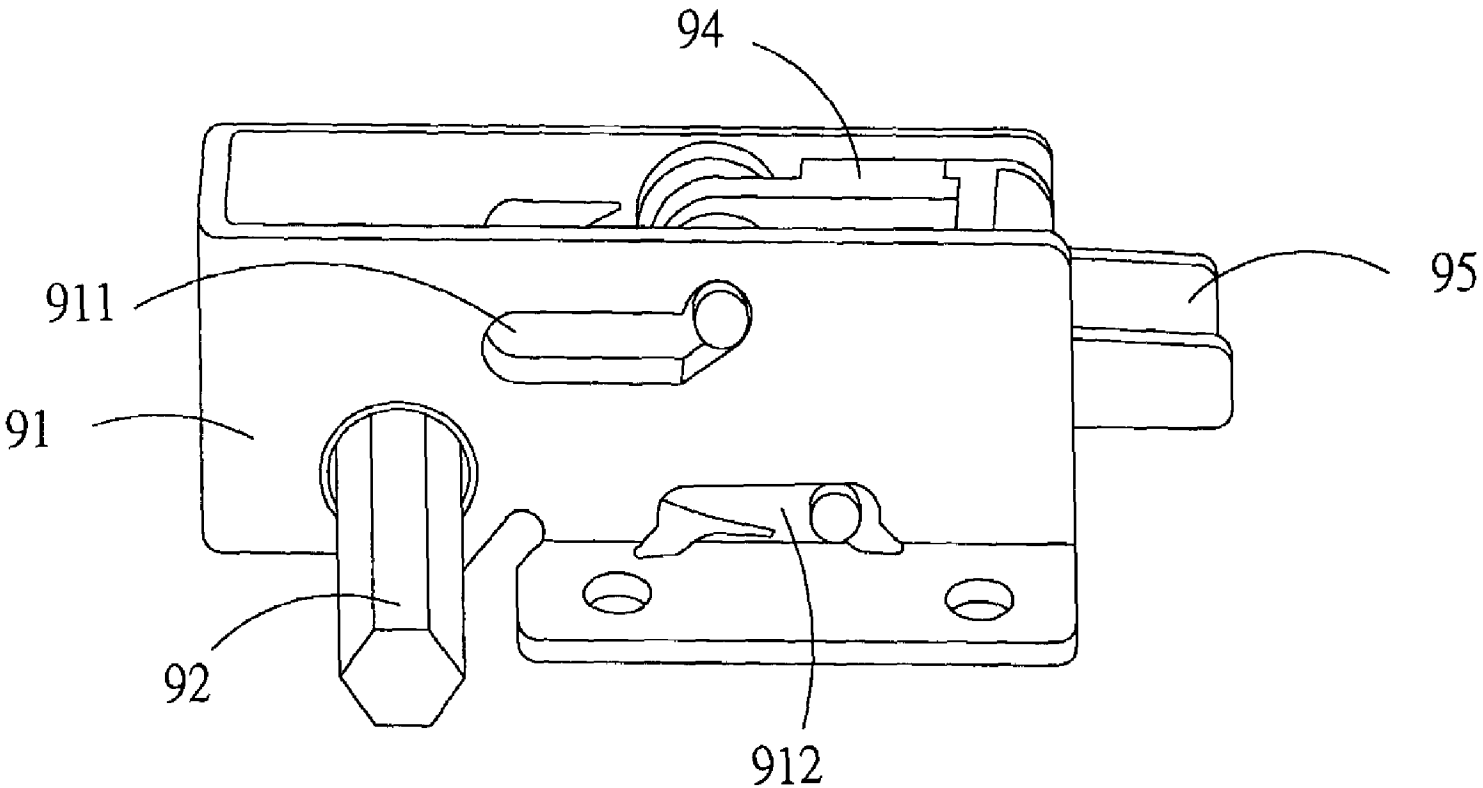
FIG 11 (PRIOR ART)
FIG. 11 (prior art) is a perspective view of the conventional remote latch mechanism of FIG. 8 in the locked state.
Figure 12:
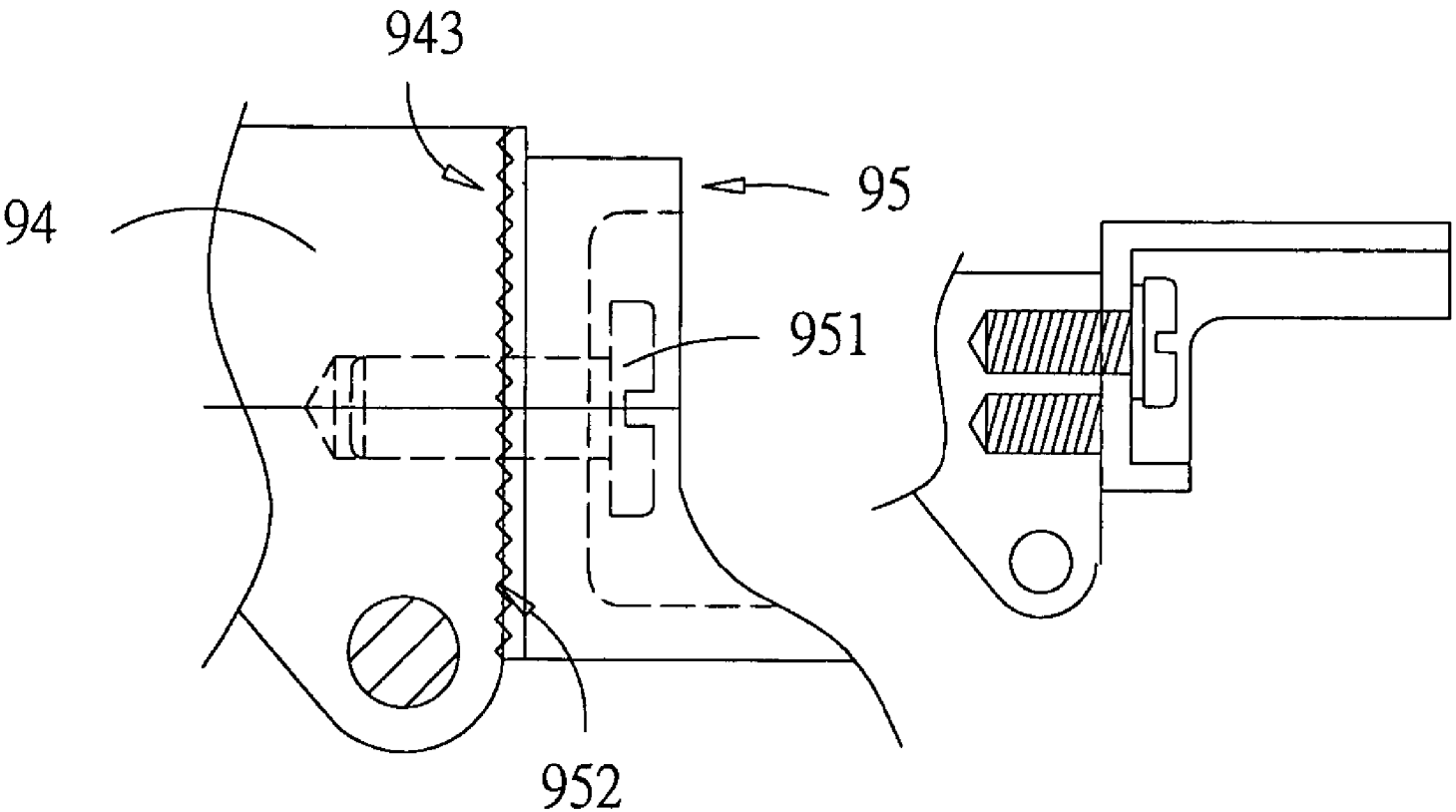
FIG 12 (PRIOR ART)
FIG. 12 (prior art) is a sectional side view of a conventional adjusting device for a remote latch 5 mechanism.

Referring to FIG. 7, in a third embodiment of the present invention, a cam 30*b* is substituted for the cam 30. The cam 30*b* has an outer surface 31*b* without a corresponding inner surface. A roller 41*b* on the inner end of the support 40 rolls along the outer surface 31*b* of the cam 30*b*, while the cam 30*b* is turned in positive direction, so that the support 40 performs the locking movement towards the outermost position 70. Furthermore, a retaining spring 49 is fastened to the inner end of the support 40, pulling the support 40 back to the innermost position 60. In contrast to the first and second embodiments of the present invention, in the third embodiment the returning movement of the pawl 50 is driven by the retaining spring 49. The cam 30*b* in the third embodiment has only one surface, which simplifies the structure thereof.

While the invention has been described with reference to preferred embodiments thereof, it is to be understood that modifications or variations may be easily made without departing from the spirit of this invention which is defined by the appended claims.

The invention claimed is:

1. A cam remote latch mechanism comprising:

a housing;

a support, placed inside said housing, being able to perform a locking movement from an innermost position to an outermost position and a reverse unlocking movement;

a plurality of guiding openings in said housing for guiding said locking and unlocking movements of said support;

a plurality of bolts, protruding from said support and respectively entering said plurality of guiding openings for guiding said locking and unlocking movements of said support;

a cam, set on a primary axis and placed inside said housing, by turning in a positive direction driving said locking movement of said support; and a pawl, mounted on an outer side of said support, protruding from said housing when said support has reached said outermost position and exerting sealing force driven by said support;

wherein said cam further comprises:

an outer surface;

an inner surface;

a first roll, mounted on said support, contacting said outer surface and rolling along said outer surface when said cam is turned in a positive direction, resulting in said support being driven in said locking movement;

a second roll, mounted on said support, contacting said inner surface and rolling along said inner surface when said cam is turned in a reverse direction, resulting in said support being driven in said unlocking movement;

a contact area on said support, touching said cam when said support has reached said outermost position, so that said support is blocked from moving beyond said outermost position;

wherein, when said support has reached said outermost position, a counterforce torque in positive direction is exerted, and said support and said cam stably hold each other.

2. The cam remote latch mechanism according to claim 1, further comprising a gliding adjusting device for adjusting the sealing force applied by said pawl, while the pawl is in the locked position.

3. The cam remote latch mechanism according to claim 2, wherein said gliding adjusting device comprises:

an adjusting screw, mounted on said support, having an axis oriented parallel to the sealing force applied by said pawl, having a head that is accessible from outside of said housing for turning said adjusting screw;

a gliding piece, attached on said pawl on an inner side that faces said support, having an inner thread engaging with said adjusting screw, so that, upon turning said adjusting screw, said pawl shifts along said adjusting screw and the sealing force applied by said pawl is adjusted.

* * * * *